US008398510B1

(12) United States Patent
Mizek et al.

(10) Patent No.: US 8,398,510 B1
(45) Date of Patent: Mar. 19, 2013

(54) EXPANDABLE ARROWHEAD OR BROADHEAD AND SPRING ELEMENT

(75) Inventors: Robert S. Mizek, Downers Grove, IL (US); Hans Vogel, Fontana, WI (US)

(73) Assignee: New Archery Products Corp., Forest Park, IL (US)

( * ) Notice: Subject to any disclaimer, the term of this patent is extended or adjusted under 35 U.S.C. 154(b) by 0 days.

(21) Appl. No.: 13/317,520

(22) Filed: Oct. 20, 2011

(51) Int. Cl.
*F42B 6/08* (2006.01)

(52) U.S. Cl. ..... 473/583

(58) Field of Classification Search ..... 473/583, 473/584

See application file for complete search history.

(56) References Cited

U.S. PATENT DOCUMENTS

| | | | | |
|---|---|---|---|---|
| 2,568,417 | A | 9/1951 | Steinbacher | |
| 2,859,970 | A | 11/1958 | Doonan | |
| 3,036,395 | A | 5/1962 | Nelson | |
| 3,578,328 | A | 5/1971 | Rickey | |
| 3,738,657 | A | 6/1973 | Cox | |
| 4,099,720 | A | 7/1978 | Zeren | |
| 4,166,619 | A | 9/1979 | Bergmann et al. | |
| 4,579,348 | A | 4/1986 | Jones | |
| 4,940,246 | A | 7/1990 | Stagg | |
| 4,973,060 | A | 11/1990 | Herzing | |
| 4,976,443 | A | 12/1990 | DeLucia | |
| 4,998,738 | A | 3/1991 | Puckett | |
| 5,046,744 | A | 9/1991 | Eddy | |
| 5,066,021 | A | 11/1991 | DeLucia | |
| 5,078,407 | A | 1/1992 | Carlston et al. | |
| 5,082,292 | A | 1/1992 | Puckett et al. | |
| 5,100,143 | A * | 3/1992 | Puckett | 473/583 |
| 5,322,297 | A | 6/1994 | Smith | |
| 5,458,341 | A | 10/1995 | Forrest et al. | |
| 5,564,713 | A | 10/1996 | Mizek et al. | |
| 5,803,844 | A | 9/1998 | Anderson | |
| 5,803,845 | A | 9/1998 | Anderson | |
| 5,820,498 | A | 10/1998 | Maleski | |
| 5,857,930 | A | 1/1999 | Troncoso | |
| 5,879,252 | A | 3/1999 | Johnson | |
| 5,941,784 | A | 8/1999 | Mizek | |
| 6,171,206 | B1 | 1/2001 | Liechty, II | |
| 6,174,252 | B1 | 1/2001 | Mizek | |
| 6,200,237 | B1 | 3/2001 | Barrie | |
| 6,217,467 | B1 | 4/2001 | Maleski | |
| 6,258,000 | B1 | 7/2001 | Liechty, II | |
| 6,287,223 | B1 | 9/2001 | Liechty, II | |
| 6,287,224 | B1 | 9/2001 | Liechty, II | |

(Continued)

OTHER PUBLICATIONS

Barrie Archery, Broadhead Catalog, 1997 (6 pages).

(Continued)

*Primary Examiner* — John Ricci
(74) *Attorney, Agent, or Firm* — Pauley Petersen & Erickson

(57) ABSTRACT

An expandable arrowhead having a blade-carrying body with a slot that houses at least one movably mounted blade. Each blade can be pivotally mounted about a shaft. In some embodiments, the shaft is fixed with respect to the body. In other embodiments, the shaft is movably mounted with respect to the body, for example by mounting a shaft within the slot so that the shaft moves within the slot with respect to the blade-carrying body. In some embodiments of this invention, a spring element positively holds one or more blades in a closed position or a retracted position, particularly during extreme forces encountered when launching an arrow from an archery bow, such as a compound archery bow. The spring element of this invention can be used to improve blade opening capabilities of conventional blade-opening arrowheads or broadheads.

23 Claims, 15 Drawing Sheets

U.S. PATENT DOCUMENTS

| | | | | |
|---|---|---|---|---|
| 6,398,676 | B1 | 6/2002 | Mizek | |
| 6,428,434 | B1 | 8/2002 | Liechty, II | |
| 6,517,454 | B2 * | 2/2003 | Barrie et al. | 473/583 |
| 6,626,776 | B2 | 9/2003 | Barrie et al. | |
| 6,669,586 | B2 * | 12/2003 | Barrie et al. | 473/583 |
| 6,755,758 | B2 | 6/2004 | Liechty, II | |
| 6,793,596 | B1 | 9/2004 | Sullivan et al. | |
| 6,830,523 | B1 | 12/2004 | Kuhn | |
| 6,910,979 | B2 * | 6/2005 | Barrie et al. | 473/583 |
| 6,935,976 | B1 * | 8/2005 | Grace et al. | 473/583 |
| 7,771,298 | B2 * | 8/2010 | Pulkrabek | 473/583 |
| 7,951,024 | B2 | 5/2011 | Mizek | |
| 8,007,382 | B1 | 8/2011 | Sanford | |
| 8,105,187 | B1 | 1/2012 | Sanford | |
| 8,197,367 | B2 * | 6/2012 | Pulkrabek et al. | 473/583 |
| 8,313,399 | B2 | 11/2012 | Sanford | |
| 2001/0006916 | A1 | 7/2001 | Liechty, II | |
| 2001/0036876 | A1 | 11/2001 | Barrie et al. | |
| 2002/0065155 | A1 | 5/2002 | Liechty, II | |
| 2002/0098926 | A1 | 7/2002 | Liechty, II | |
| 2003/0004021 | A1 | 1/2003 | Barrie et al. | |
| 2003/0073525 | A1 | 4/2003 | Liechty, II | |
| 2003/0153417 | A1 | 8/2003 | Barrie et al. | |
| 2009/0203477 | A1 | 8/2009 | Mizek et al. | |
| 2010/0273588 | A1 | 10/2010 | Pulkrabek | |
| 2012/0220400 | A1 | 8/2012 | Pulkrabek et al. | |

OTHER PUBLICATIONS

Co-Pending U.S. Appl. No. 13/452,533, filed Apr. 20, 2012; inventors Robert S. Mizek et al.; title Expandable Arrowhead or Broadhead and Spring Element.

Co-Pending U.S. Appl. No. 13/317,519, filed Oct. 20, 2011; inventors Robert S. Mizek et al.; title Expandable Arrowhead or Broadhead.

* cited by examiner

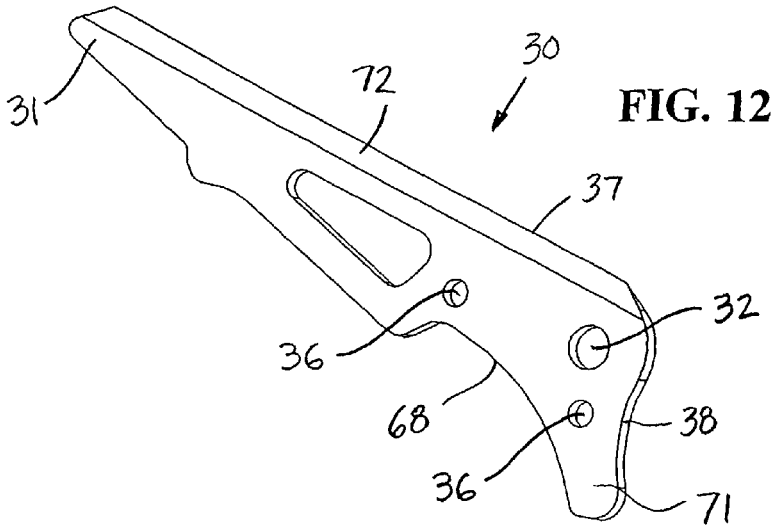
FIG. 12
FIG. 13
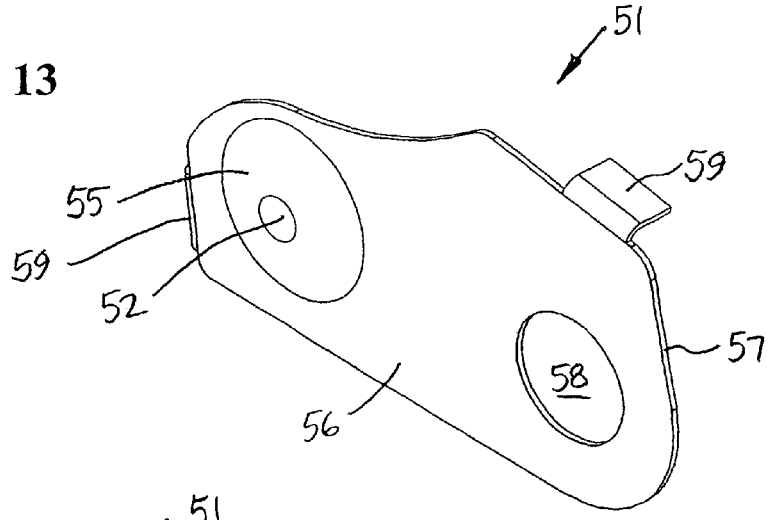
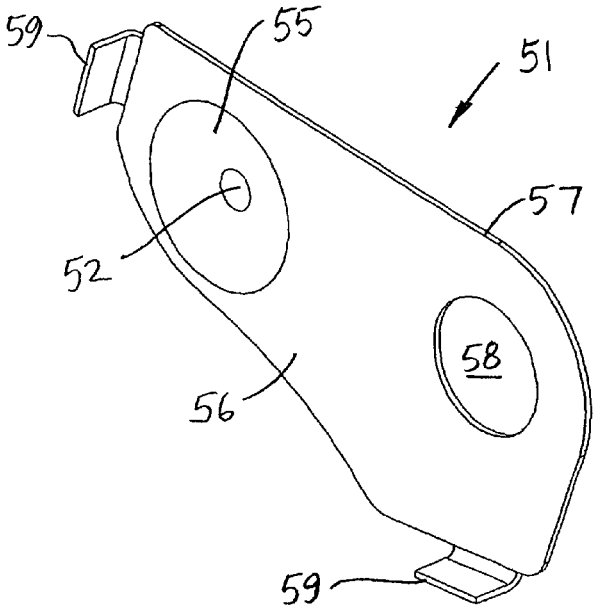
FIG. 14

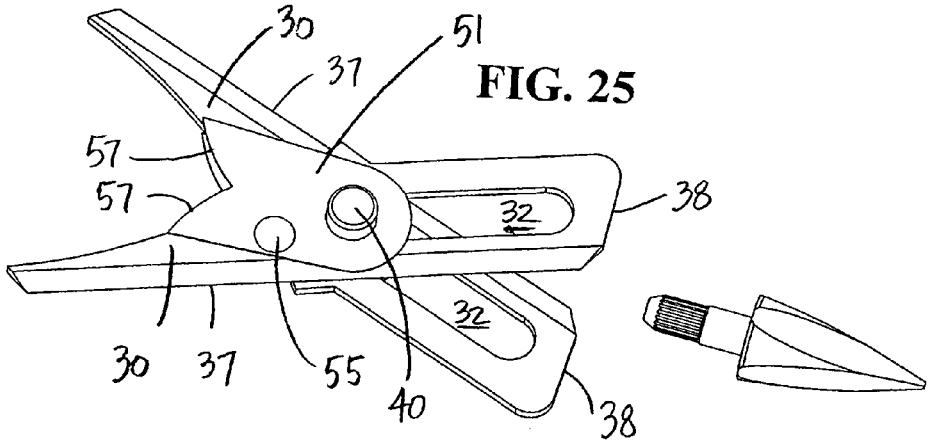
FIG. 25
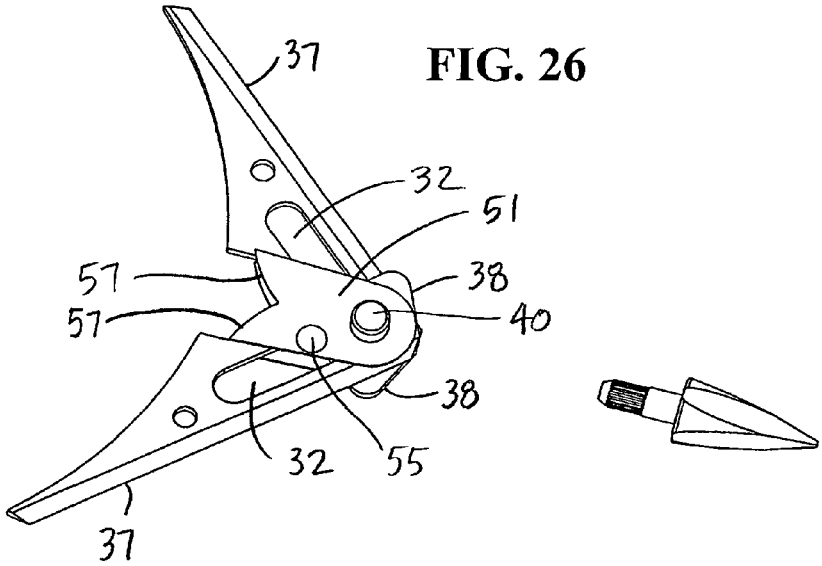
FIG. 26
FIG. 27
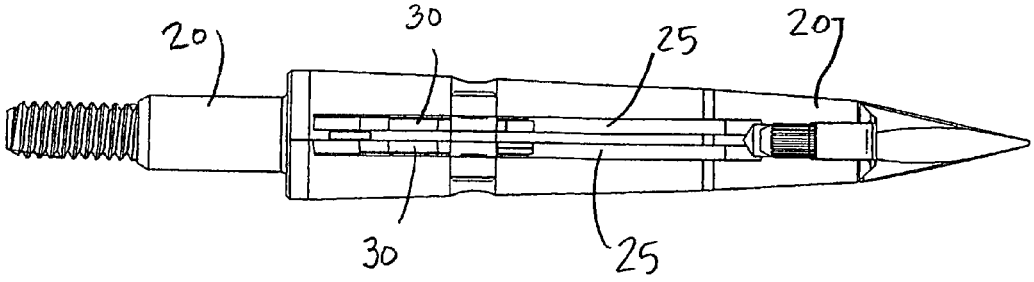

EXPANDABLE ARROWHEAD OR BROADHEAD AND SPRING ELEMENT

BACKGROUND OF THE INVENTION

1. Field of the Invention

This invention relates to an expandable arrowhead or broadhead having one or more blades that each are movably mounted within a slot of a blade-carrying body, and during movement from a retracted position to an expanded position each blade pivots and/or translates with respect to the blade-carrying body.

2. Discussion of Related Art

Many conventional blade-opening arrowheads or broadheads are designed to launch and fly or travel in a closed position or a retracted position and then upon impact with a target to move to an opened position or an expanded position in which cutting edges of the blades are exposed to the target. When an arrow is launched from an archery bow, a tremendous amount of forces are generated from the archery bow, particularly a compound archery bow, and transferred through the arrow shaft and into the arrowhead. When experiencing the relatively high gravitational or G-forces during arrow launch, many conventional blade-opening arrowheads have one or more blades that undesirably move out of the closed position or the retracted position, which decreases aerodynamic performance of the arrowhead and thus of the overall arrow.

To hold or maintain all blades of the arrowhead in the closed position during launch and flight, many conventional blade-opening arrowheads use an elastic band, such as a rubber band, or an O-ring to hold all blades in the closed position, until the arrowhead strikes the target and either breaks, severs or moves away the elastic band, rubber band or O-ring.

There is an apparent need for an expandable arrowhead or broadhead that positively holds, maintains or keeps each blade of a blade-opening arrowhead in the closed position or the retracted position during launch and flight of an archery arrow. There is also an apparent need for an apparatus, method and/or system that can be used to enhance or improve the ability for conventional expandable arrowheads or broadheads to maintain each blade in the closed position, particularly during launch and flight of an archery arrow.

SUMMARY OF THE INVENTION

In some embodiments of the expandable arrowhead according to this invention, a spring element is used to hold a corresponding movably mounted blade in a retracted position, particularly while encountering the relatively high forces generated at and through an arrow and a corresponding arrowhead when launched from an archery bow, until impact with a target at which time the blade moves to the expanded position. In other embodiments according to this invention, the spring element can be added to conventional blade-opening arrowheads or broadheads, to improve the capability and performance and thus allow each blade to remain in the closed position until impact with the target.

In some embodiments according to this invention, a blade-carrying body has two different slots within a ferrule body or other suitable blade-carrying body. At least one blade is movably mounted within each slot. It is possible to mount two or more blades within each slot. Each blade has an impact portion that receives an impact force upon contact with the target and also a cutting portion that is exposed to the target when the blade is in the expanded position. Each blade is designed to move from the retracted position to the expanded position when the impact force traveling through the blade overcomes a resistance bias force exerted by the spring element on the blade.

In some embodiments of this invention, the cutting portion of each blade is positioned or located opposite of the impact portion, for example so that the cutting portion is on one side and the impact portion is on another side of the body and/or the slot of the body. The spring element, the cutting portion, the impact portion and/or the shape and dimensions of the slot can be varied to accommodate different desired cutting patterns and/or blade opening capabilities.

According to some embodiments of this invention, a shaft is movably mounted within a second slot of the blade-carrying body, and the second slot is different than the first slot that houses a corresponding blade. The shaft can move with respect to the blade-carrying body when the blade moves between the retracted position and the expanded position. Movement of the shaft within the second slot allows the blade to translate or move in a generally linear direction with respect to the blade-carrying body. In some embodiments having the shaft movably mounted within the second slot, the blade also pivots about the shaft or moves in a radial direction about the shaft, and in such embodiments each blade can move along or follow a pivoting and translating movement path when the blade moves between the retracted position and the expanded position. In some embodiments of this invention, the spring element piggybacks the blade and thus moves with the blade, with respect to the body.

According to other embodiments of this invention, a shaft is fixedly mounted with respect to the blade-carrying body, for example within the second slot of the blade-carrying body. In some embodiments, the shaft only pivots or otherwise radially moves with respect to the blade-carrying body when the blade moves between the retracted position and the expanded position. Fixing or securing the shaft with respect to the blade-carrying body, for example within the second slot, can be used to prevent the blade from moving in a generally linear direction with respect to the blade-carrying body. In some embodiments having the shaft fixedly mounted with respect to the blade-carrying body, for example within the second slot, the blade only pivots about the shaft or only moves in a radial direction about the shaft. In some embodiments of this invention, when the shaft is fixedly mounted with respect to the blade-carrying body, for example within the second slot, the spring element remains fixed with respect to the body and thus does not move with the blade, with respect to the body.

The spring element of this invention can be used in combination with other elements of this invention and/or can be used as an improvement to conventional blade-opening arrowheads or broadheads.

BRIEF DESCRIPTION OF THE DRAWINGS

This invention is explained in greater detail below in view of exemplary embodiments shown in the drawings, wherein:

FIG. 12 is a perspective view of a blade, according to one embodiment of this invention;

FIG. 13 is a perspective side view of a spring element, according to one embodiment of this invention;

FIG. 14 is a perspective side view, opposite the side view shown in FIG. 13, of the spring element shown in FIG. 13;

FIG. 25 is a perspective view of blades and a spring element of the expandable arrowhead as shown in FIG. 23, with the blades in the retracted position;

FIG. 26 is a perspective view of the blades and the spring element of the expandable arrowhead as shown in FIG. 23, with the blades in the expanded position;

FIG. 27 is a front view of the expandable arrowhead as shown in FIG. 23;

DESCRIPTION OF PREFERRED EMBODIMENTS

FIGS. 1-37 show different embodiments of expandable arrowhead 10 according to this invention. As used throughout this specification and in the claims, the term expandable arrowhead or expandable broadhead is intended to relate to and include any apparatus and/or method in which one or more blades each moves between a retracted position and an expanded position, and while moving with respect to a blade-carrying body each blade pivots and/or translates with respect to the blade-carrying body, for example so that when moving between the retracted position and the expanded position each blade translates in a generally longitudinal direction of the blade-carrying body and/or pivots or moves radially outward from the blade-carrying body. Elements and method steps of this invention cooperate with and/or supplemented by other elements and/or method steps known to those skilled in the art of designing and manufacturing arrowheads and broadheads. For example, U.S. Pat. Nos. 5,564,713, 5,941,784, 6,174,252, 6,398,676, 6,517,454, 6,626,776, 6,910,979 and 6,935,976, the entire teachings of each and every one of which are incorporated into this specification by reference thereto, relate to pivoting and/or translating blade-opening arrowheads or broadheads that can remain in a closed position or a retracted position during arrow launch and flight and then move into an opened position or an expanded position upon impact at or with a target, including devices, systems and method steps which can be used in connection with the apparatus and/or the method and/or the system of the expandable arrowhead or broadhead according to this invention.

FIGS. 1-33 show different embodiments of a blade-opening expandable arrowhead 10 according to this invention. Many embodiments of this invention relate to expandable arrowhead 10 having both pivotal and translational movement between the retracted position and the expanded position. However, in other embodiments of this invention, expandable arrowhead 10 can have only pivotal movement or only translational movement. As used throughout this specification and in the claims, the terms expandable arrowhead, expandable broadhead, blade-opening arrowhead, blade-opening broadhead, arrowhead, broadhead and other similar terms are intended to be interchangeable with each other and relate to any arrowhead that opens, expands and/or moves from a closed position or a retracted position during arrow launch and flight to an opened position or an expanded position upon impact at or with a target.

Figure 1:
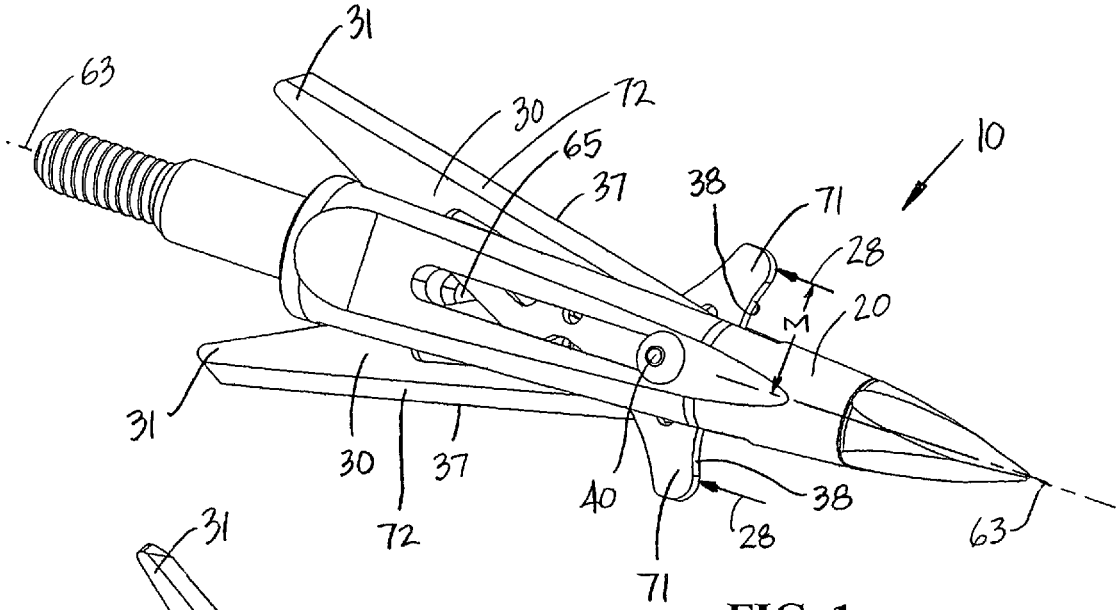
FIG. 1 is a perspective view of an expandable arrowhead, in a retracted position, according to one embodiment of this invention.
Figure 2:
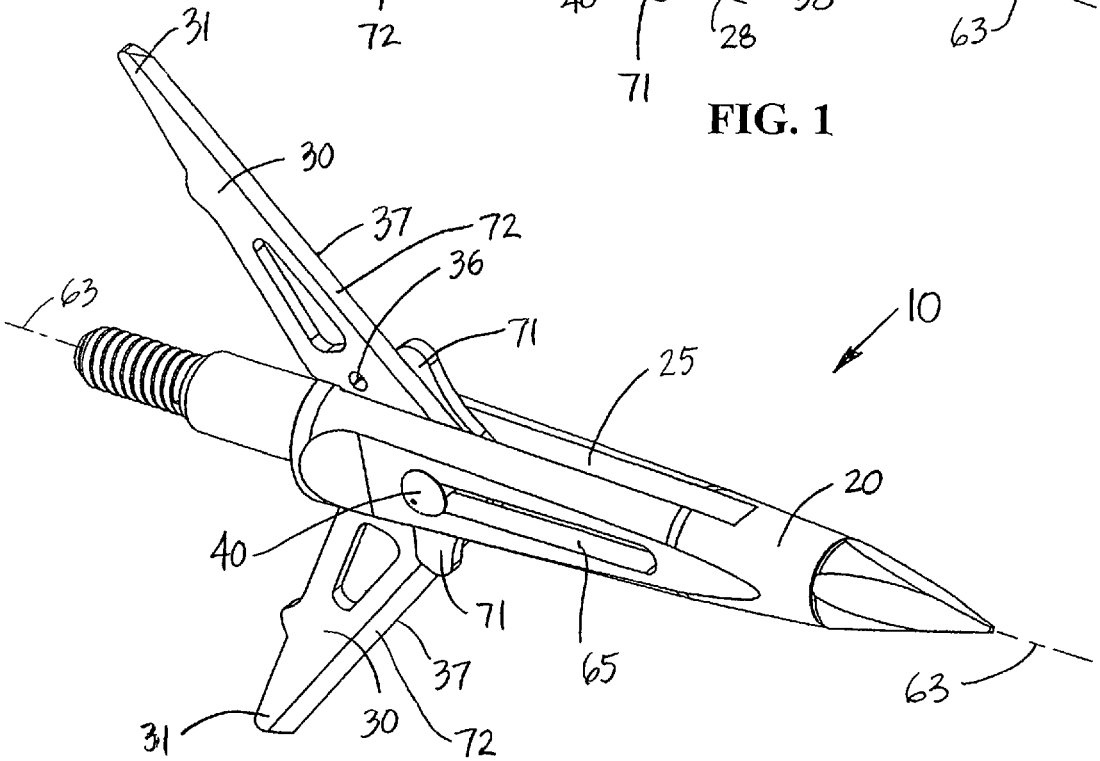
FIG. 2 is a perspective view of the expandable arrowhead as shown in FIG. 1, but in an expanded position.
Figure 3:
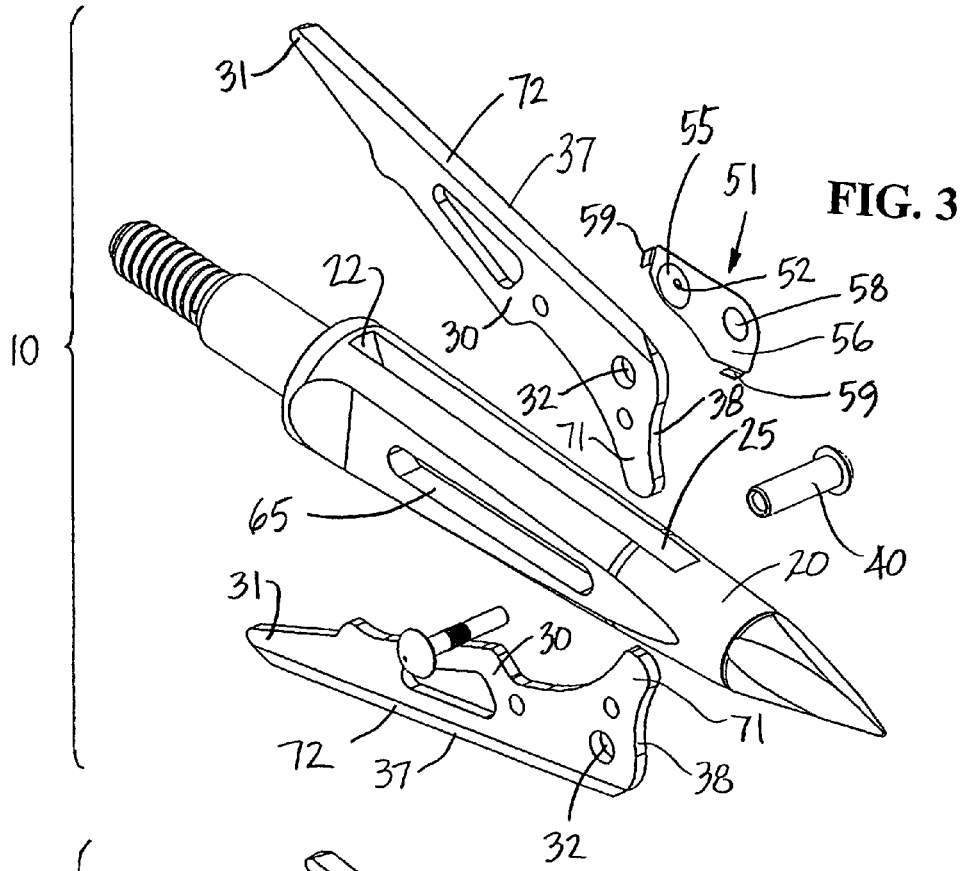
FIG. 3 is an exploded perspective view of the expandable arrowhead as shown in FIG. 1, from one side.
Figure 4:
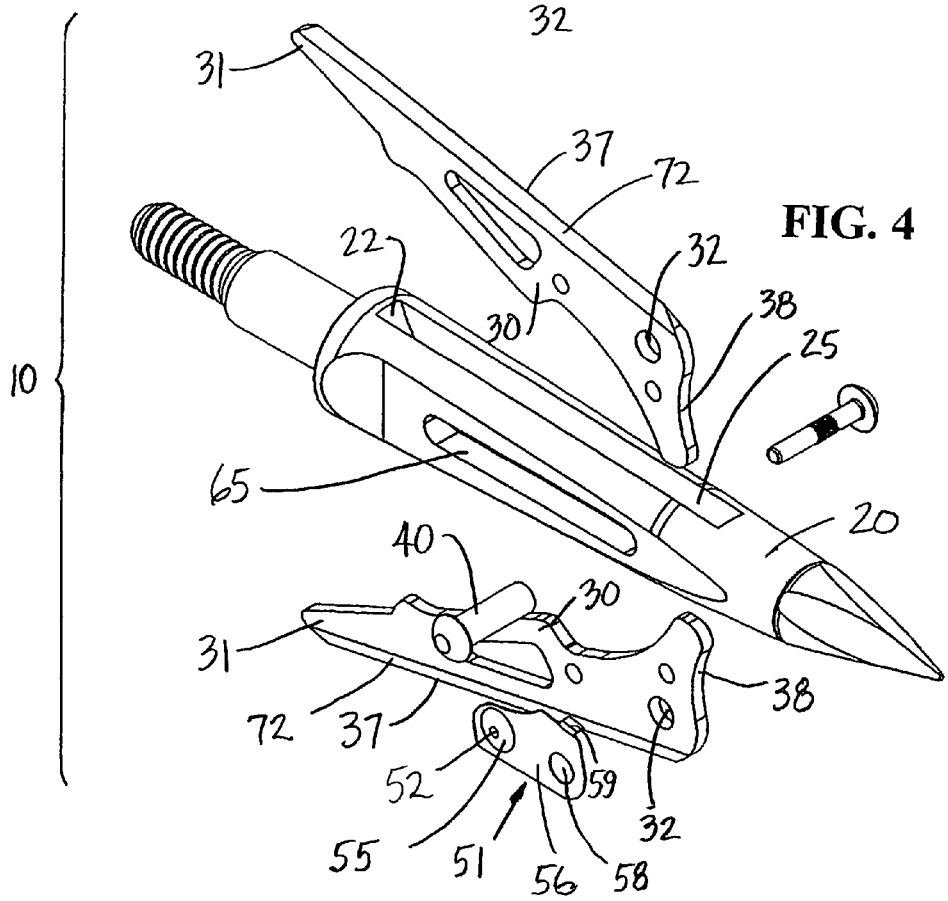
FIG. 4 is an exploded perspective view of the expandable arrowhead as shown in FIG. 1, from a side opposite the side shown in FIG. 3.
Figure 5:
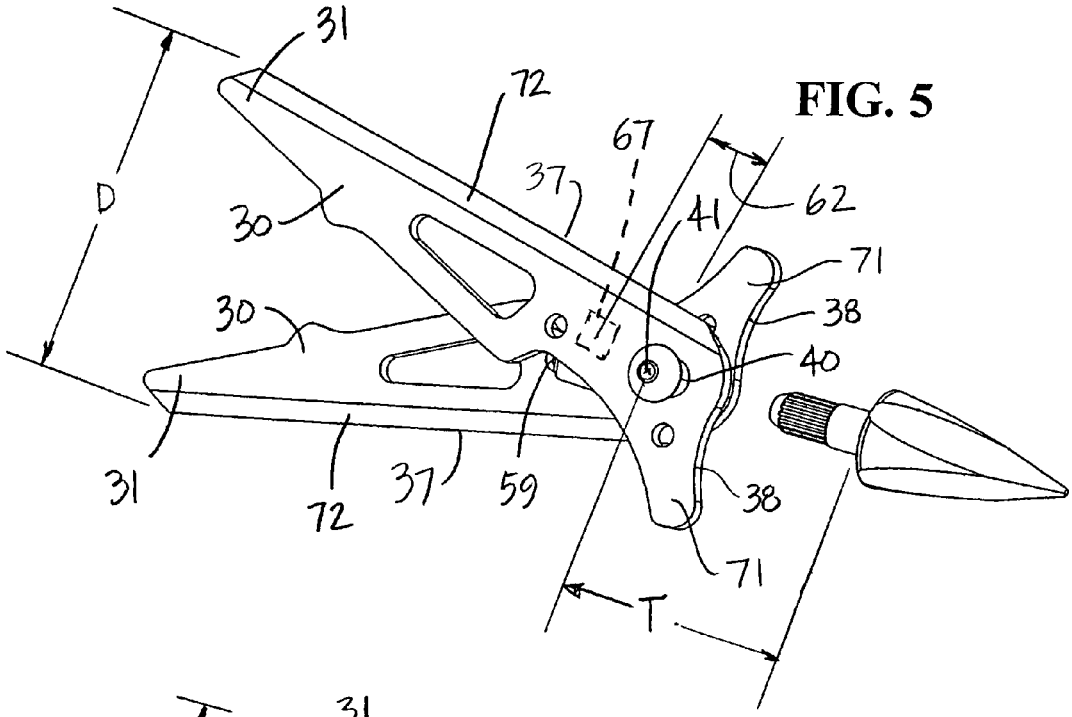
FIG. 5 is a perspective view of the expandable arrowhead as shown in FIG. 1, with the ferrule body hidden to show the blades in the retracted position.
Figure 6:
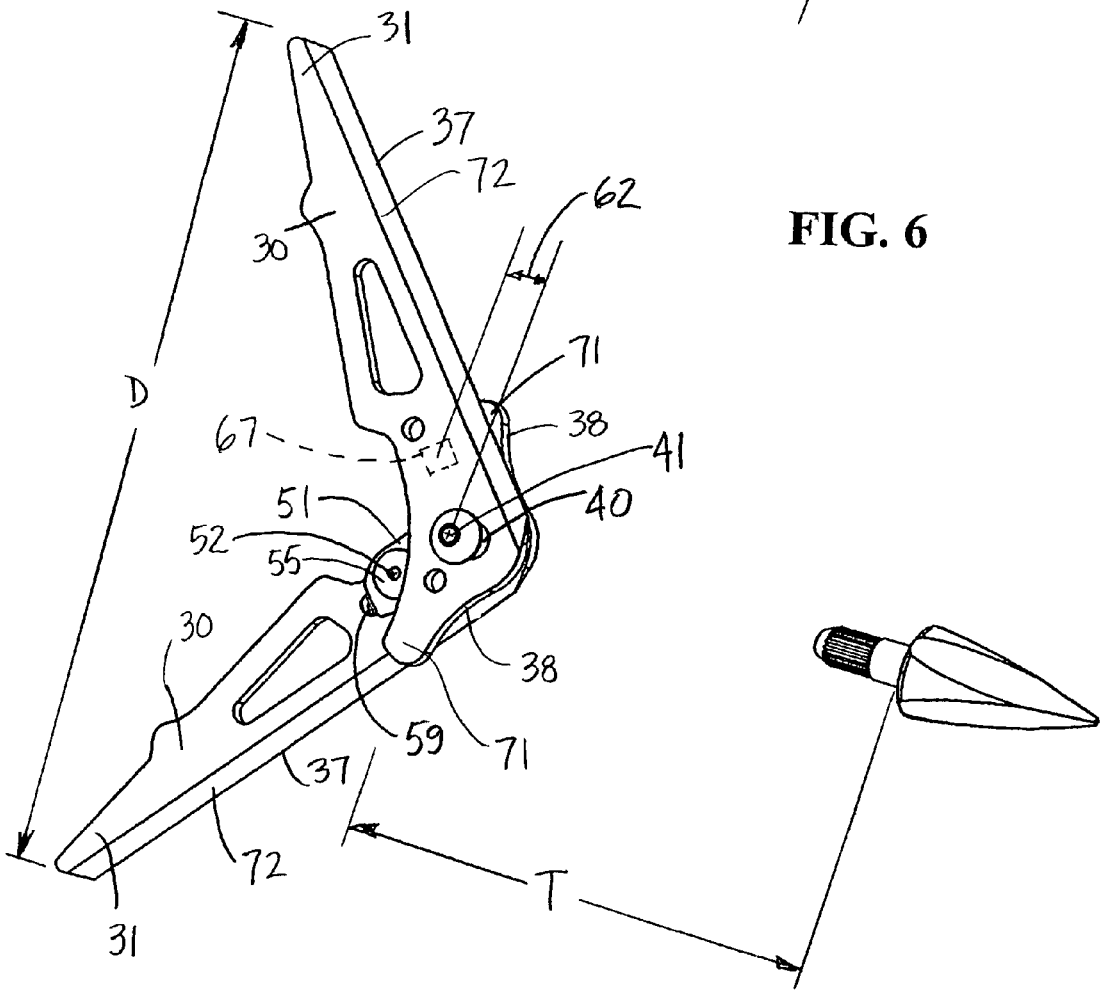
FIG. 6 is a perspective view of the expandable arrowhead as shown in FIG. 1, with the ferrule body hidden to show the blades in the expanded position.

For example, FIG. 1 shows one embodiment of arrowhead 10 in a closed position or a retracted position, and FIG. 2 shows the same embodiment of arrowhead 10 in an opened position or expanded position. FIGS. 5 and 6 show the same embodiment of arrowhead 10 operating between the retracted position of FIG. 5 and the expanded position of FIG. 6. As shown between FIGS. 1 and 2 and also between FIGS. 5 and 6, the cutting diameter D increases and translational distance T, the distance blade 30 moves in a generally longitudinal direction along or with respect to body 20, increases as arrowhead 10 moves from the retracted position to the expanded position. Thus, in some embodiments according to this invention, between the retracted position and the expanded position, blade 30 pivots and translates with respect to blade-carrying body or body 20. In other embodiments of this invention, blade 30 only pivots or only translates or only moves along some other suitable path, with respect to body 20.

Figure 9:
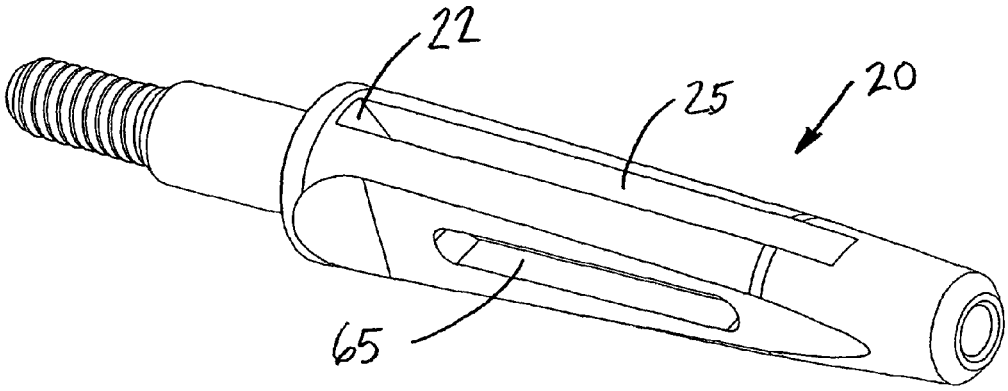
FIG. 9 is a perspective view of a ferrule body, according to one embodiment of this invention.
Figure 10:
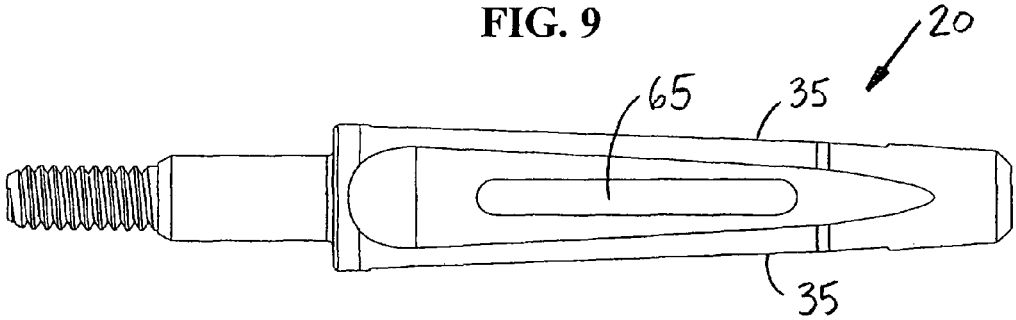
FIG. 10 is a front view of the ferrule body as shown in FIG. 9.
Figure 11:
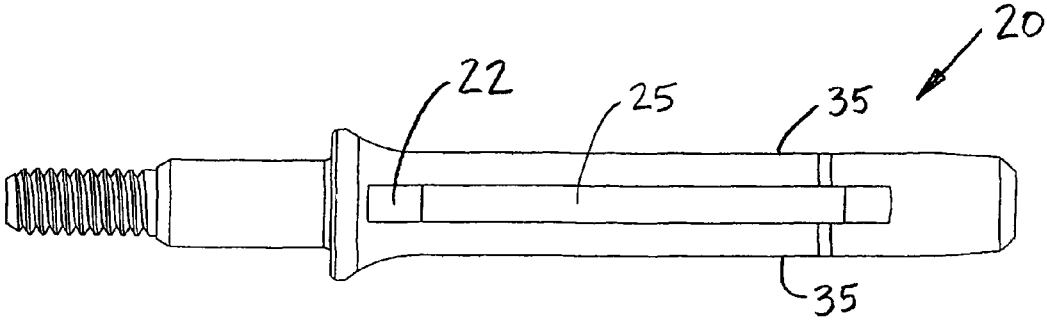
FIG. 11 is a top view of the ferrule body as shown in FIG. 9.
Figure 15:
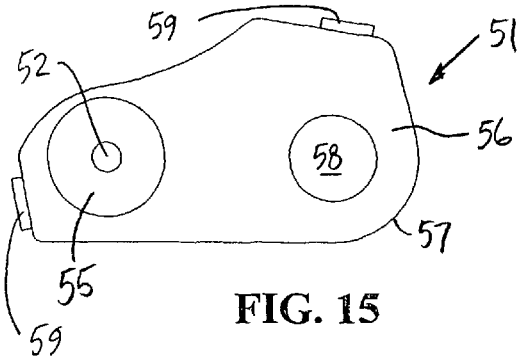
FIG. 15 is a front view of the spring element as shown in FIG. 13.
Figure 16:
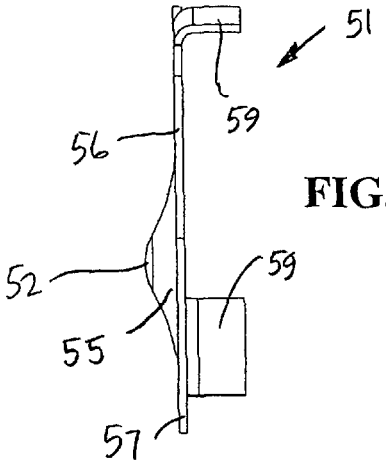
FIG. 16 is a side view of the spring element as shown in FIG. 13.
Figure 17:
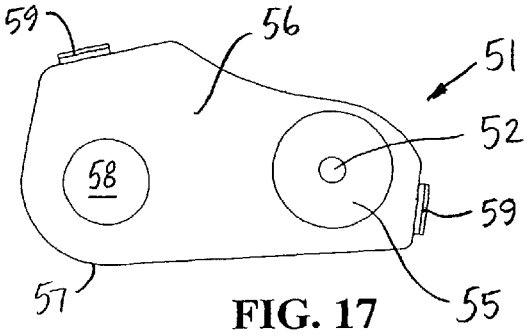
FIG. 17 is a rear view of the spring element as shown in FIG. 13.
Figure 18:
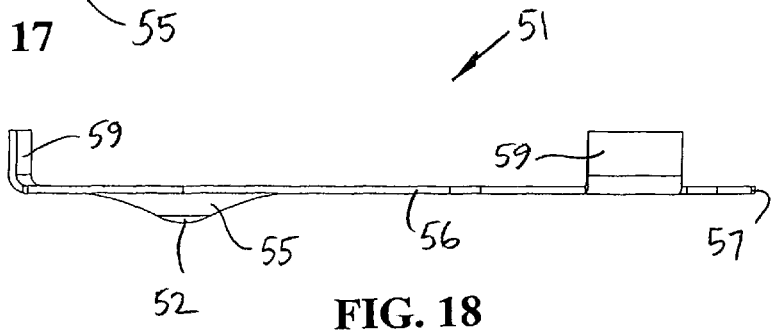
FIG. 18 is a top view of the spring element as shown in FIG. 13.
Figure 19:
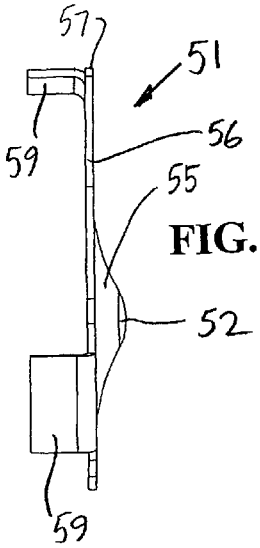
FIG. 19 is a side view, opposite the side view shown in FIG. 16, of the spring element as shown in FIG. 13.
Figure 20:
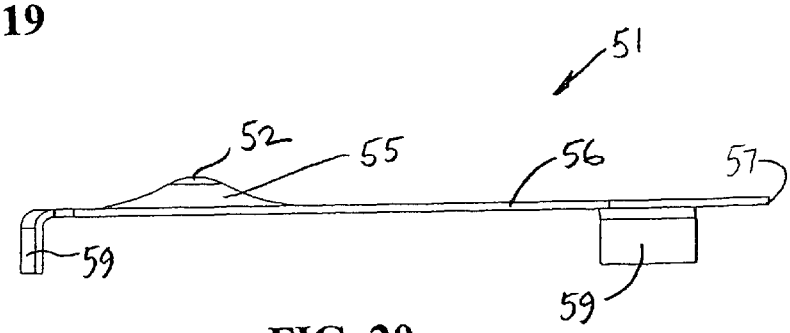
FIG. 20 is a bottom of the spring element as shown in FIG. 13.

In some embodiments according to this invention, such as shown in FIGS. 9-11, body 20 comprises slot 25 and slot 65. Slot 25 and/or slot 65 can extend across or from one side to another side of body 20. Slot 25 and slot 65 can merge into each other and/or intersect with each other. In other embodiments of this invention, slot 25 can be separated or independent from slot 65. Slot 25 and/or slot 65 can have the same or similar shapes and dimensions as shown in FIGS. 9-11, or can have any other suitable different shape and/or dimension.

As shown in FIGS. 1-4, for example, two blades 30 are movably mounted within one slot 25. In other embodiments according to this invention, one blade 30 or three or more blades 30 can be movably mounted within each slot 25. Many conventional broadheads or arrowheads have ferrules or blade-carrying bodies with three or more slot configurations, so that the broadhead or arrowhead can have three or more movably mounted blades 30. For example, U.S. Pat. No. 6,910,979 discloses arrowheads having three or more slot configurations. In some embodiments of this invention, each blade 30 has one corresponding slot 25 within which the one blade 30 is movably mounted and no slot 25 has more than one blade 30 movably mounted. In other embodiments of this invention with three or more slots 25, some slots 25 house only one blade 30 and at least one other slot 25 houses more than one blade 30.

As shown between FIGS. 1 and 2, for example, at least a portion of blade 30 is movably mounted within slot 25. Blade 30 can be movably mounted to pivot, rotate, move along an arc, translate, move along a longitudinal direction and/or move in or along any other desired direction or movement path, by using elements taught by this invention or any other suitable elements that accomplish a similar movement. Also as shown in FIG. 1, for example, impact portion 71 and cutting portion 72 of each blade 30 are positioned or located on or at opposite sides of slot 25. As shown in FIG. 1, for example, a distance of moment arm M can be increased or decreased to increase or decrease torque applied to blade 30 when opening force or impact force 28 is applied to impact portion 71, such as through or along blunt edge 38. Also, the size and/or shape of impact portion 71 and/or blunt edge 38 can be varied to differently apply a resutant impact force 28 and thus differently move blade 30. In some embodiments of this invention, moment arm M provides a mechanical advantage for transferring opening forces, such as impact force 28, from impact portion 71 through blade 30 to open and expose sharp edge 37 of blade 30 to the target material.

Figure 7:
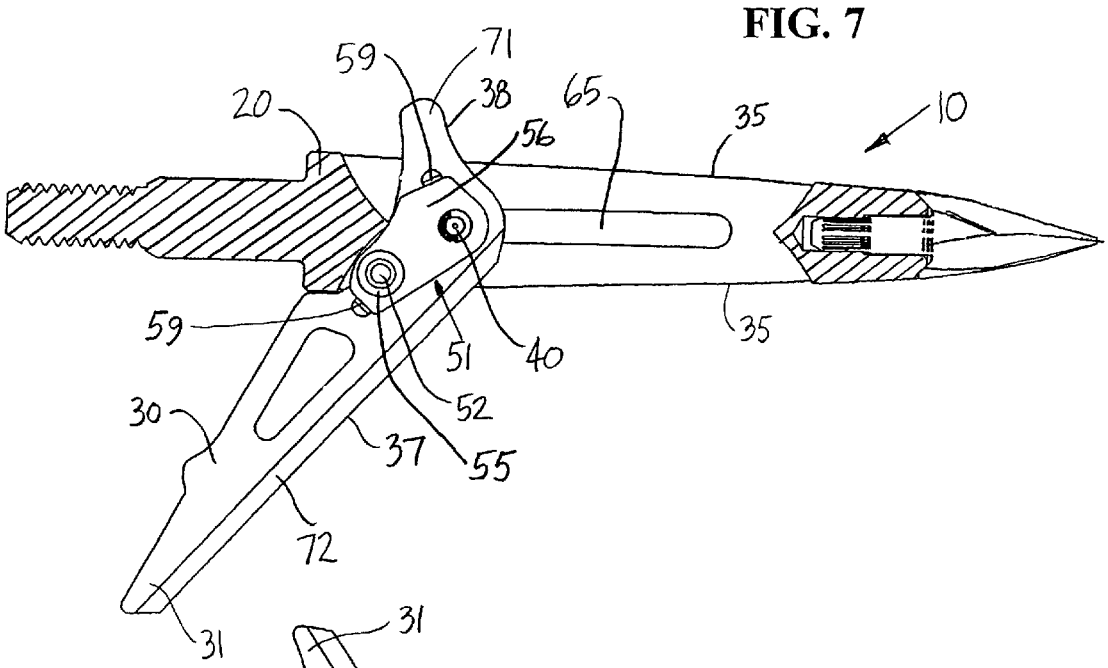
FIG. 7 is a sectional view taken along a centerline or central axis of the expandable arrowhead as shown in FIG. 1, with the blade shown in the expanded position.

In some embodiments of this invention, at least a portion of cutting portion 72 of blade 30 extends beyond outer surface 35 of body 20, such as shown in FIG. 7, when arrowhead 10 is in the retracted position and/or the expanded position. In other embodiments of this invention, cutting portion 72 can be completely contained within slot 25 so that no portion of cutting portion 72 extends beyond outer surface 35 of body 20 when arrowhead 10 is in the retracted position and/or the expanded position.

Figure 8:
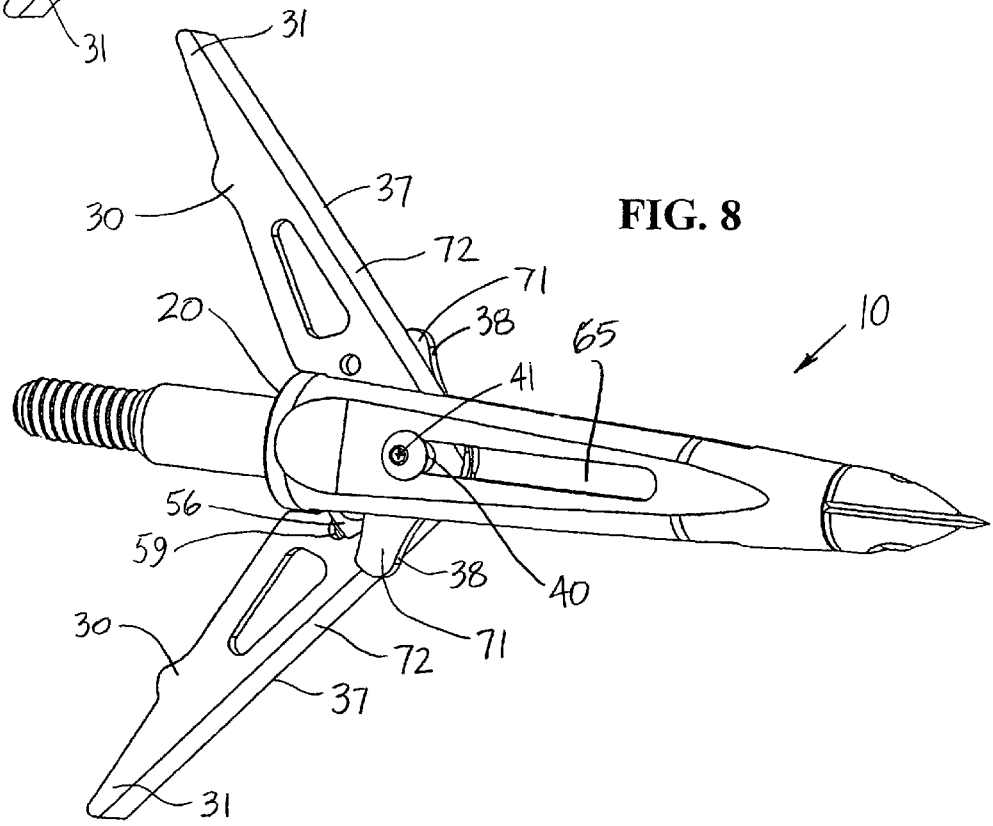
FIG. 8 is a perspective view of an expandable arrowhead, in an expanded position, according to another embodiment of this invention.

As shown in FIGS. 1 and 2, for example, impact portion 71 and cutting portion 72 of the same blade 30 are on opposite sides of slot 25. In some embodiments according to this invention, impact portion 71 is on an opposite side of longitudinal axis 63, such as shown in FIGS. 1, 2 and 8. With impact portion 71 oppositely positioned of or with respect to cutting portion 72, in some embodiments of this invention, a greater or different force can be used to open blade 30 or to move blade 30 from the retracted position to the expanded position.

In some embodiments according to this invention, such as shown in FIGS. 1-8, blade 30 has bore or opening 32 and pivot shaft or shaft 40 is mounted within opening 32. In some embodiments of this invention, blade 30 pivots about shaft 40 and/or center axis 41. The size and shape of opening 32 as well as the size and shape of shaft 40 can be varied to accomplish different pivoting actions or other similar or different movements of blade 30 with respect to body 20 and/or shaft 40. For example, opening 32 can form a circle with a diameter that forms a relatively loose fit about shaft 40, or can have a diameter that forms a relatively tight fit about shaft 40, depending upon the frictional resistance and relative movement desired between blade 30 and shaft 40. As shown in FIGS. 23-34, for example, opening 32 can form a non-circle, such as a slot, that can be sized and shaped to result in more than just pivotal movement of blade 30 with respect to shaft 40, for example can result in pivotal and/or translational movement of blade 30 with respect to shaft 40. In some embodiments according to this invention, opening 32 forms a relatively straight or linear slot while in other embodiments of this invention opening 32 forms a relatively non-linear, arcuate and/or curved slot.

As shown in FIGS. 1, 2, 21 and 22, for example, shaft 40 is movably mounted within slot 65. In some embodiments of this invention, shaft 40 slides, translates or otherwise moves within slot 65 and with respect to body 20. In other embodiments of this invention, shaft 40 can be movably mounted with or without slot 65 to slide, translate or otherwise move in a general longitudinal direction of body 20 or in any other suitable direction with respect to body 20. In other embodiments of this invention, shaft 40 can be fixed with respect to body 20, and for example, can be securely fixed and/or fixed with limited movement in a pivotal or translational direction. As shown in the drawings, shaft 40 has a circular or a generally circular cross-section. In other embodiments of this invention, shaft 40 can have a different cross sectional shape and/or can be sized and/or shaped to allow movement of shaft 40 with respect to body 20.

In some embodiments of this invention, arrowhead 10 further comprises spring element 51 mounted with respect to blade 30 and/or relaeasably fixed with respect to blade 30, to provide or supply a bias force to, upon and/or against blade 30, by direct contact and/or indirect contact. In some embodiments of this invention, spring element 51 biases, urges or otherwise forces or moves blade 30 into the retracted position. In some embodiments of this invention, spring element 51 contacts blade 30, directly or indirectly, such as in a frictional manner, a mechanical manner and/or in another engageable manner.

FIGS. 3-7 show one embodiment of how spring element 51 is secured or otherwise attached with respect to blade 30. FIGS. 13-20 show one embodiment of spring element 51 comprising two lock tabs 59, shown as extending away from baseplate or body 56 of spring element 51. FIG. 7 shows one embodiment of spring element 51 mounted with respect to blade 30. As shown, each of the two lock tabs 59 fits within or is releasably engaged within bore or recess 36 of blade 30. In some embodiments according to this invention, the fit between spring element 51 and blade 30 is relatively tight, resulting in increased friction and thus little or no movement of spring element 51 with respect to blade 30. In other embodiments according to this invention, the fit between spring element 51 and blade 30 is relatively loose, resulting in less friction and some movement of spring element 51 with respect to blade 30. In some embodiments of this invention, spring element 51 piggybacks with, rides with and/or moves with blade 30 as blade 30 pivots, translates and or otherwise moves with respect to body 20.

Spring element 51 may comprise only one lock tab 59 or more than two lock tabs 59. Lock tab 59 can have the shape and/or dimensions as shown in FIGS. 13-20, or can have any other suitable shape that allows spring element 51 to be fixed, secured or otherwise mounted with respect to blade 30, with either a tight fit or a loose fit. Spring element 51 can further comprise through hole or opening 58 within which shaft 40 is mounted, in some embodiments of this invention. Opening 58 can form a circular bore or a non-circular bore. The clearance between spring element 51 and shaft 40 can be selected to provide either a relatively tight fit or a relatively loose fit between spring element 51 and shaft 40. With shaft 40 mounted within opening 58 of spring element 51, only one lock tab 59 is needed to hold or fix the position of spring element 51 on or with respect to blade 30. Spring element 51 can releasably hold or removably fix blade 30 in the retracted position, such as by spring element 51 having at least one lock tab 59 and contact portion 52 or another similar structure interfering with movement of blade 30 and/or spring element 51.

As shown in FIGS. 13-20, spring element 51 may further comprise detent 55 and/or raised portion or contact portion 52, which can be integrated with each other as shown in FIGS. 13-20 or can be separated from each other. In some embodiments according to this invention, detent 55 and/or raised portion 52 each contacts outer or skin surface or surface 68 of blade 30. The size, dimensions and/or internal bias force of detent 55 and/or raised portion 52 can be varied to provide or supply a desired or a selected bias force acting upon blade 30. In other embodiments of this invention, detent 55 and/or raised portion 52 engages within bore or recess 36 and/or another suitable opening within blade 30, to releasably hold blade 30 in the retracted position.

In some embodiments according to this invention, opening force or impact force 28 applied to impact portion 71 and/or blunt edge 38 transfers forces through blade 30, providing torque about shaft 40 and/or center axis 41, to move blade 30 from the retracted position to the expanded position. Features or parts of impact portion 71 and or blunt edge 38, for example, including but not limited to the moment arm acting at or through blade 30, can be sized and designed to overcome the bias force of spring element 51 acting upon and holding or urging blade 30 in the retracted position. Thus, as arrowhead 10 enters a target material, spring element 51 and/or blade 30 can be designed to enter the target material with blade 30 in the retracted position and then upon contact between impact portion 71 and the target material move blade 30 into the expanded position, such as for exposing sharp edge 37 and/or cutting portion 72 to and thus cutting the target material.

Spring element 51 can releasably hold blade 30 in the retracted position. In some embodiments according to this invention, such as shown in FIGS. 1-7, spring element 51 is mounted to and thus piggybacks, rides or moves with blade 30 as blade 30 pivots and/or translates with respect to body 20. In other embodiments according to this invention, such as shown in FIGS. 23-34, spring element 51 remains fixed in place or stationary with respect to body 20, and in some embodiments as blade 30 moves with respect to body 20, blade 30 also moves with respect to spring element 51 because spring element 51 remains relatively fixed or in a stationary position, allowing for fit tolerances, with respect to body 20.

Thus, in some embodiments according to this invention, spring element 51 pivots, translates or otherwise moves with blade 30 from the retracted position to the expanded position, and in other embodiments of this invention, spring element 51 remains fixed to, detachably secured to and/or releasably attached to body 20 or another suitable element fixed with respect to body 20, and blade 30 does not pivot, translate or otherwise move with blade 30 from the retracted position to the expanded position.

Figure 28:
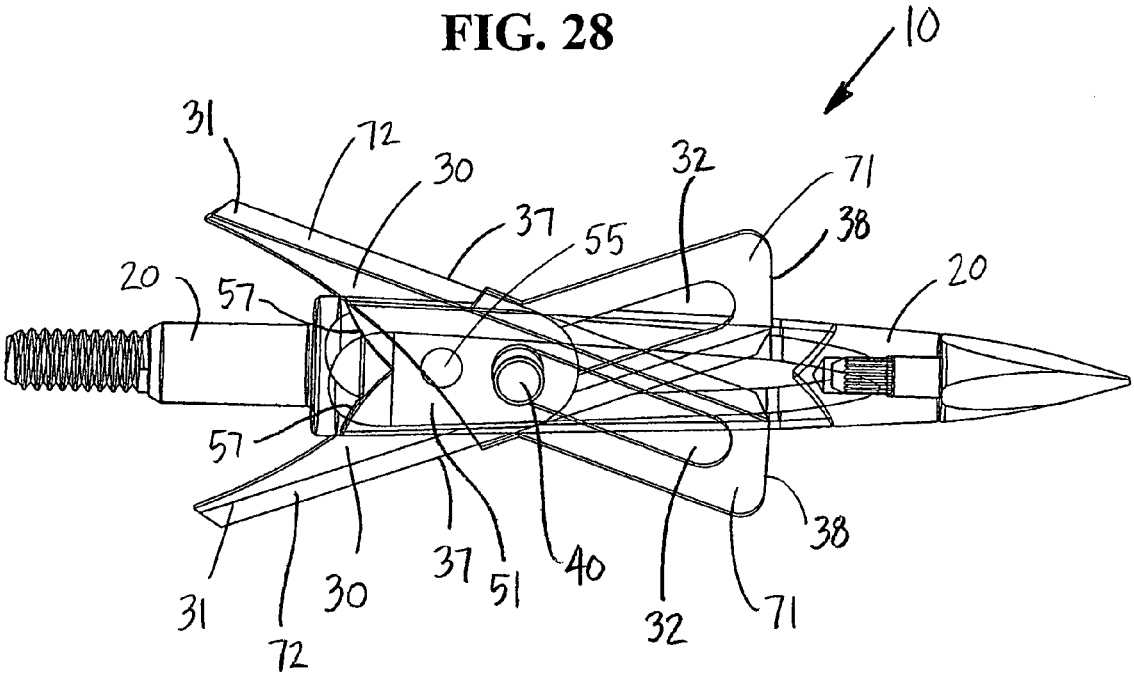
FIG. 28 is a front transparent view of an expandable arrowhead, according to another embodiment of this invention.

As shown in FIGS. 25 and 26, for example, side edge 57 abuts or contacts body 20, such as at sidewall 22, a shoulder portion and/or another suitable structural portion of body 20. When assembled, such as shown in FIG. 28 for example, shaft 40 mounted within bore 32 forms an interference fit and side edge 57 contacting body 20 limits or prevents movement of spring element 51 with respect to body 20. Although side edge 57 is shown with an arcuate curve, side edge 57 can have a straight or linear shape and/or a curved or non-linear shape, in other embodiments according to this invention.

In some embodiments of this invention, such as shown in FIGS. 28-37 for example, spring element 51 has raised portion 52 and/or detent 55 positioned between side edge 57 and opening 58 of spring element 51. In other embodiments according to this invention, the relative position of opening 58 and raised portion 52 and/or detent 55 can be switched or can have yet a different configuration or position arrangement.

In some embodiments of this invention, spring element 51 comprises a wave washer, a disc spring, a circular spring, a Belleville spring and/or any other suitable bias element and/or spring device. In some embodiments of this invention, spring element 51 is positioned between two corresponding blades 30, while in other embodiments of this invention spring element 51 is positioned between blade 30 and body 20, and in still yet other embodiments of this invention spring element 51 is positioned between any other suitable structure or device part of or similar to body 20 and/or another blade 30. Intermediate elements can be directly or indirectly positioned between spring element 51 and body 20, blade 30 and/or any other structure, part or piece of or cooperating with body 20 and/or blade 30.

In some embodiments according to this invention, spring element 51 releasably holds blade 30 in the retracted position and when moving between the retracted position and the expanded position blade 30 follows a pivoting and translating movement path. In other embodiments according to this invention, blade 30 follows a different pivoting and/or translating movement path. Spring element 51 comprises contact portion 52 interfering with blade 30 along at least a portion of the pivoting and translating movement path of blade 30. In some embodiments according to this invention, as blade 30 moves along the pivoting and translating movement path between the retracted position and the expanded position, such as shown from FIG. 5 to FIG. 6, for example, distance 62 is varied between a shaft axis, such as center axis 41, of shaft 40 and a contact area 67 formed at, near or between contact portion 52 and blade 30 and/or body 20 and/or any other suitable structure or element directly or indirectly connected to blade 30 and/or body 20.

In some embodiments of this invention, spring element 51 contacts shaft 40 at or near opening 58 and spring element 51 has a lock surface engageable with body 20 and/or any other suitable structure, to prevent movement of spring element 51 with respect to body 20 as blade 30 follows the pivoting and translating movement path.

Figure 21:
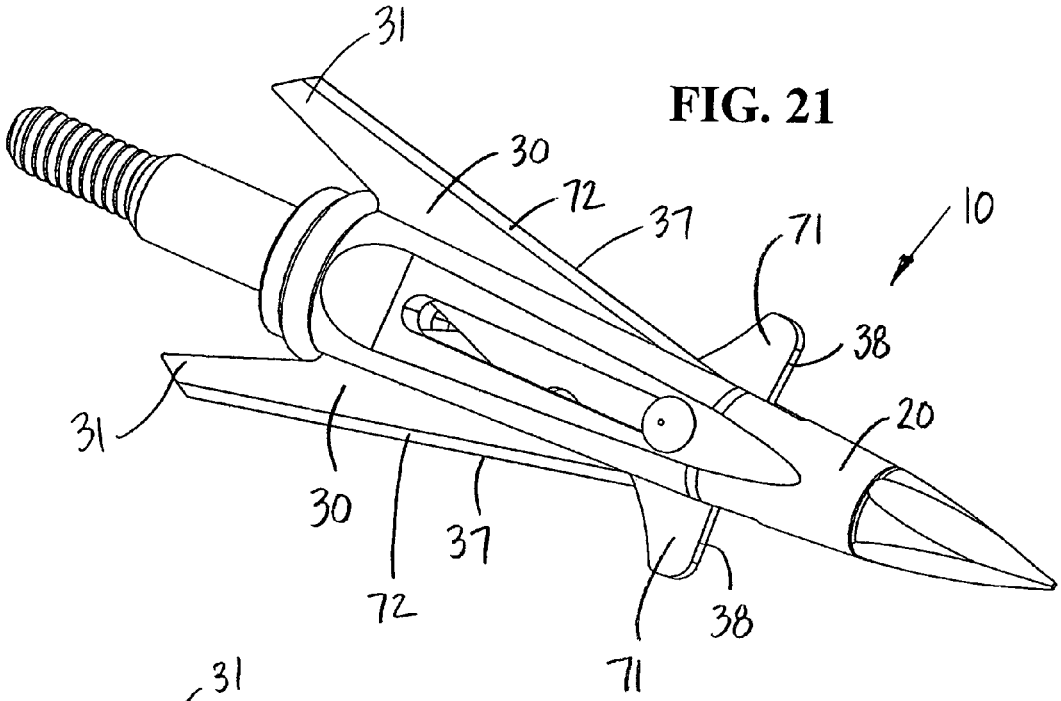
FIG. 21 is a perspective view of an expandable arrowhead according to another embodiment of this invention, showing blades in the retracted position.
Figure 22:
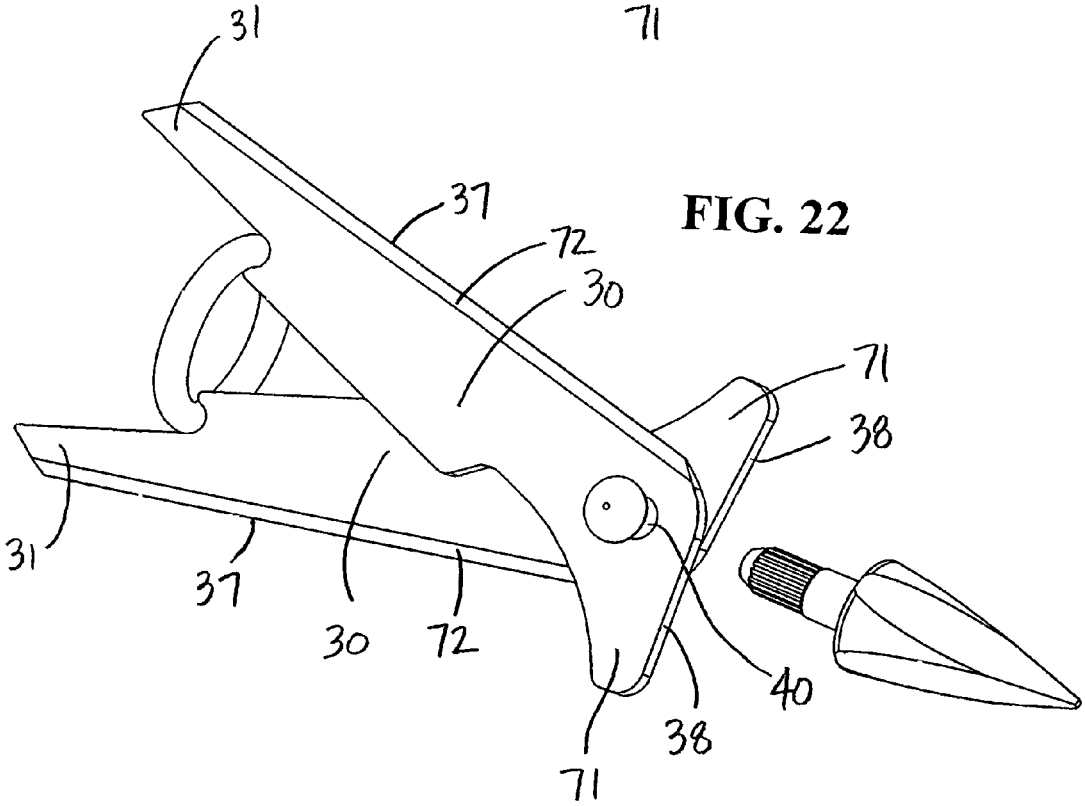
FIG. 22 is a perspective view of blades and an O-ring, with the body hidden, of the expandable arrowhead as shown in FIG. 21.

FIGS. 21 and 22 show expandable arrowhead 10, according to one embodiment of this invention. In this embodiment, O-ring 75 is used in lieu of spring element 51, but in other embodiments can be used in addition to spring element 51, to hold each blade 30 in the retracted position. Upon impact with the target material, impact force 28 acts upon impact portion 71 to open each blade 30 into the expanded position. O-ring 75 can be designed for reuse or for disposable.

Figure 23:
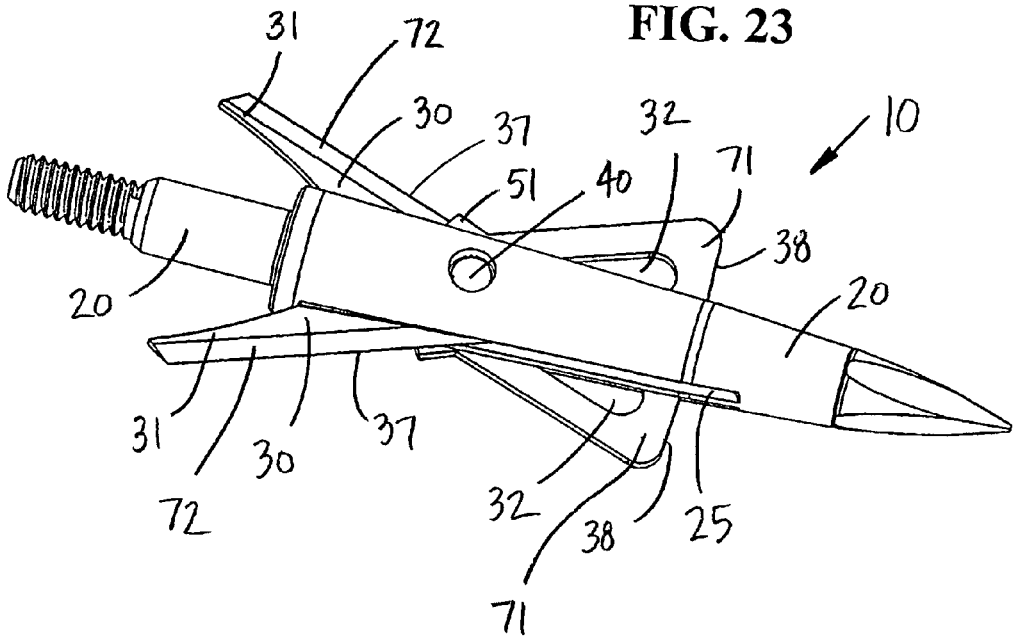
FIG. 23 is a perspective view of an expandable arrowhead according to another embodiment of this invention, showing blades in the retracted position.
Figure 24:
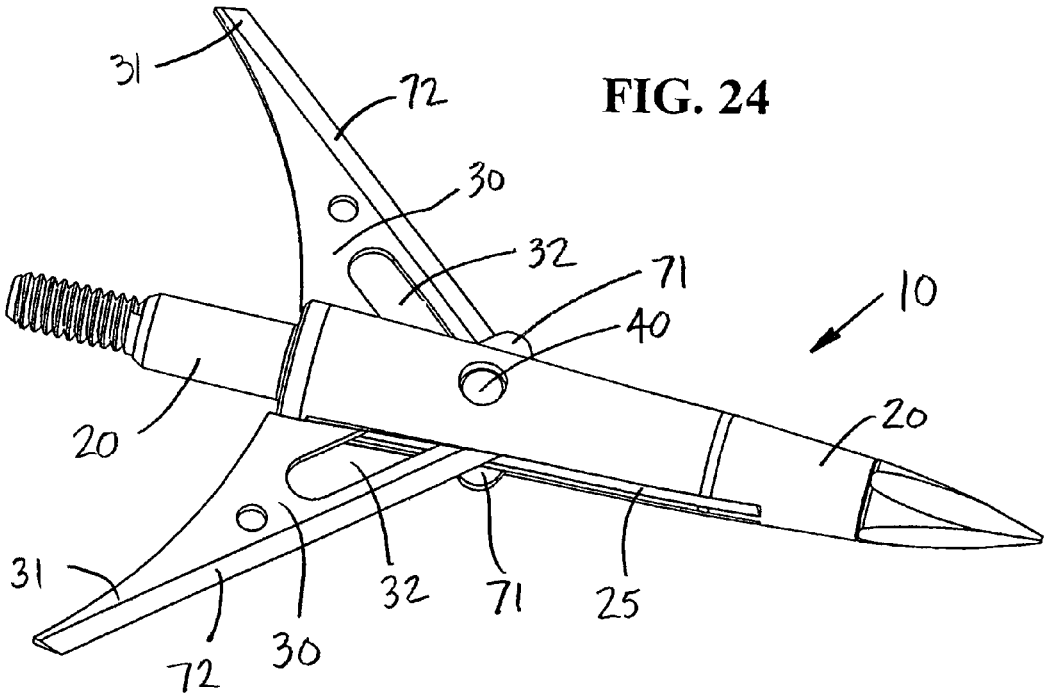
FIG. 24 is a perspective view of the expandable arrowhead as shown in FIG. 23, showing the blades in the expanded position.

FIGS. 23-27 show another embodiment of expandable arrowhead 10 according to this invention. FIG. 23 shows arrowhead 10 in the retracted position and FIG. 24 shows arrowhead 10 in the expanded position. FIGS. 25 and 26 show spring element 51 remaining in a fixed or relatively stationary position with respect to body 20, and each blade 30 moves with respect to spring element 51 and body 20 between the retracted position and the expanded position. FIG. 27 shows body 20 having two slots 25 and two blades 30 with each blade 30 mounted within one corresponding slot 25.

Figure 29:
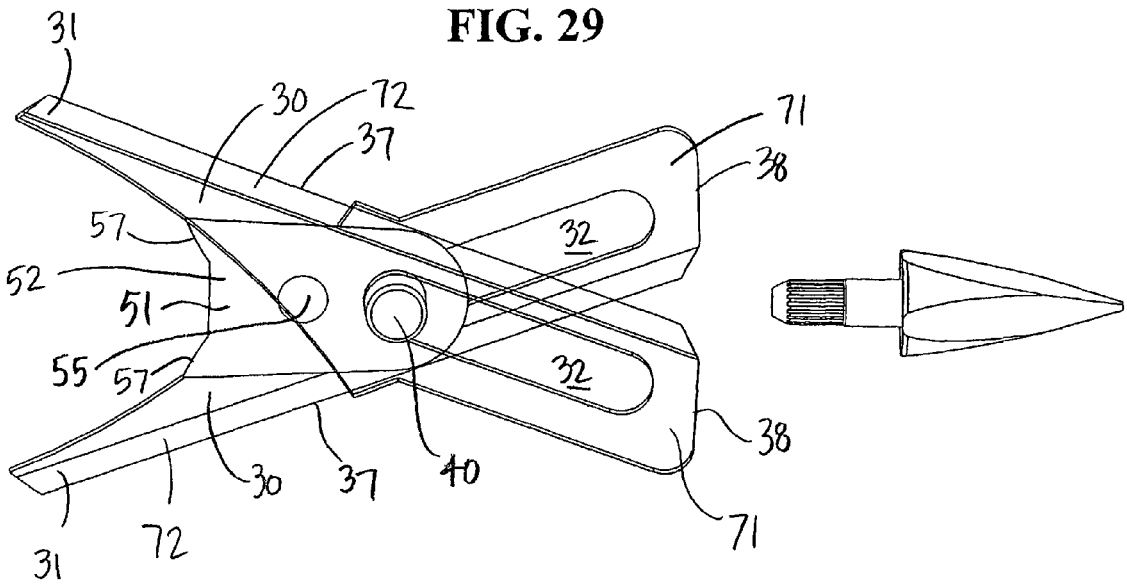
FIG. 29 is a front view of blades and a spring element, showing the blades in the retracted position, of the expandable arrowhead as shown in FIG. 28.
Figure 30:
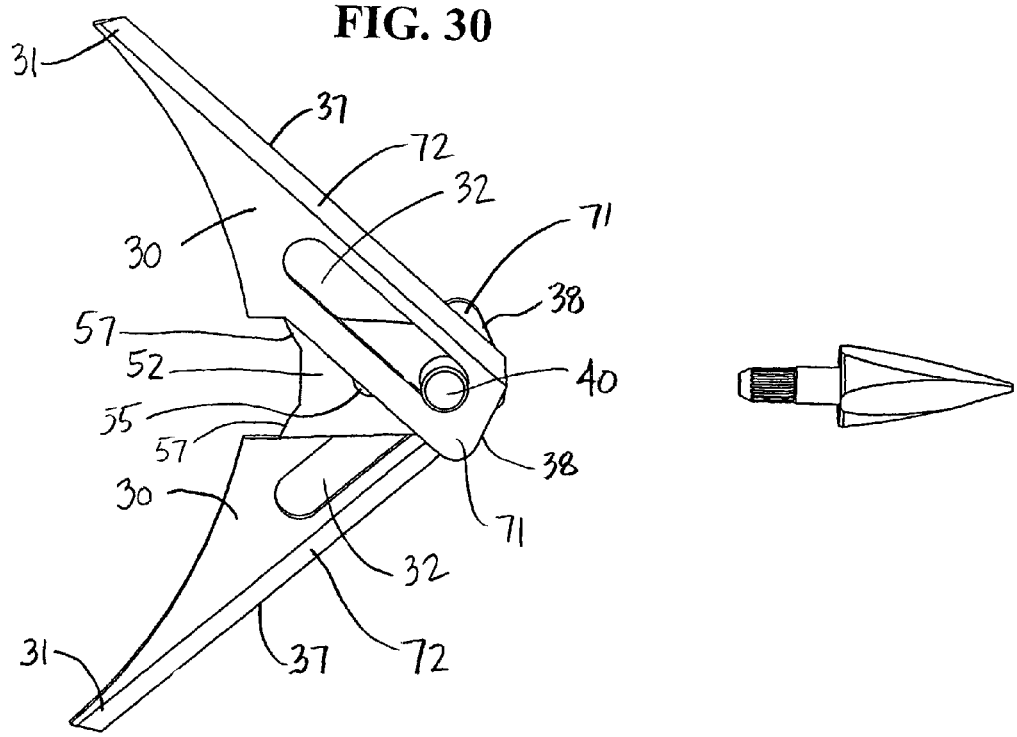
FIG. 30 is a front view of blades and a spring element, showing the blades in the expanded position, of the expandable arrowhead as shown in FIG. 28.
Figure 31:
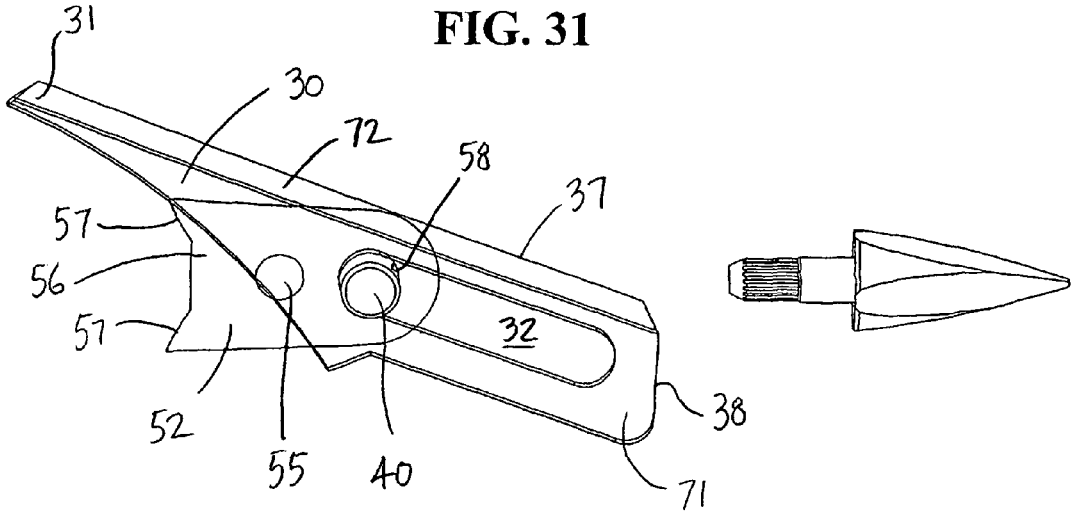
FIG. 31 is a front view of one blade and one spring element, showing the blade in the retracted position, of the expandable arrowhead as shown in FIG. 28.
Figure 32:
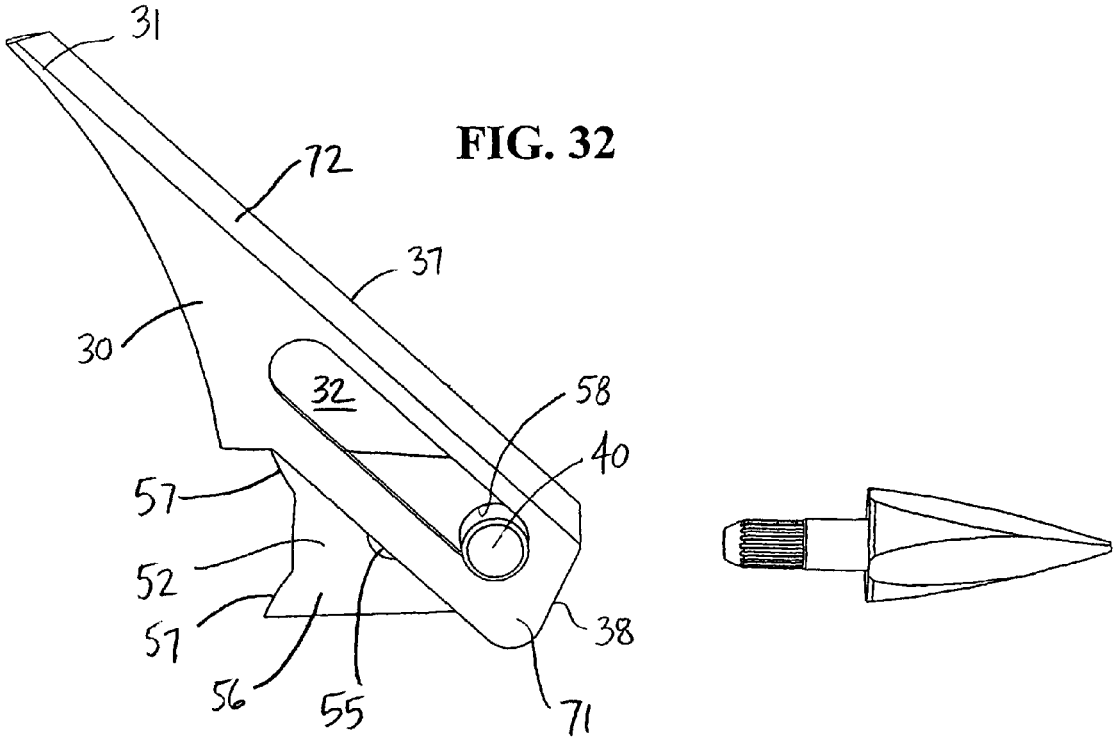
FIG. 32 is a front view of the blade and the spring element shown in FIG. 31, showing the blade in the expanded position, of the expandable arrowhead as shown in FIG. 28.
Figure 33:
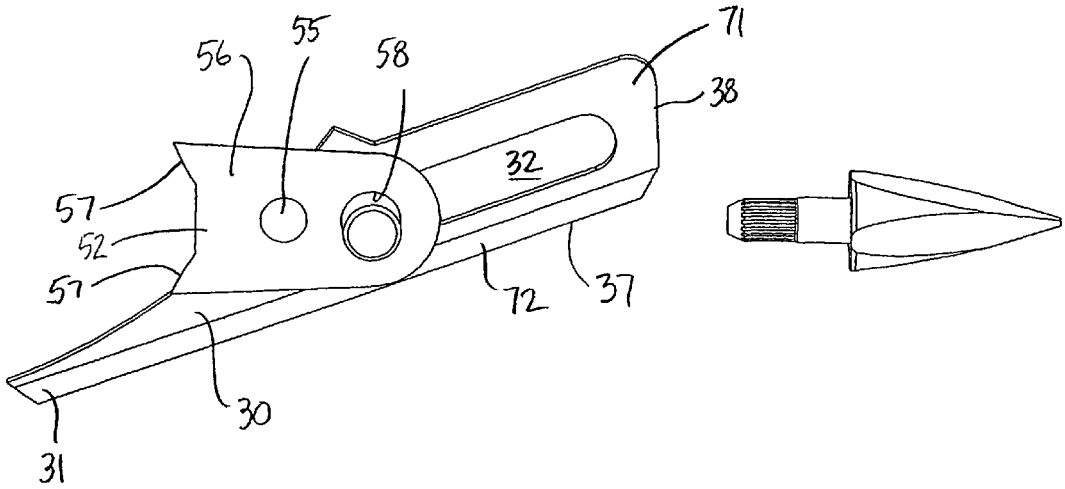
FIG. 33 is a front view of another blade and the spring element, showing the other blade in the retracted position, of the expandable arrowhead as shown in FIG. 28.
Figure 34:
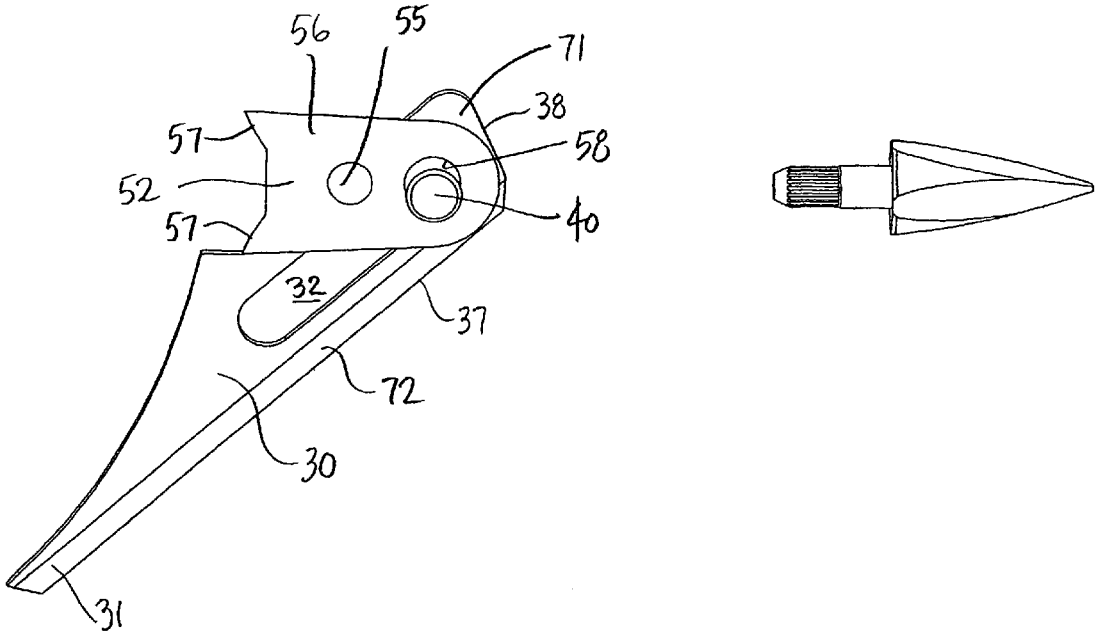
FIG. 34 is a front view of the blade and the spring element shown in FIG. 33, showing the blade in the expanded position, of the expandable arrowhead as shown in FIG. 28.

FIGS. 28-34 show another embodiment of expandable arrowhead 10 according to this invention. FIG. 29 shows blades 30 in the retracted position and FIG. 30 shows blades 30 in the expanded position. As shown in FIGS. 29-34, spring element 51 remains in a fixed or relatively stationary position with respect to body 20, and each blade 30 moves with respect to spring element 51 and body 20 between the retracted position and the expanded position.

Figure 35:
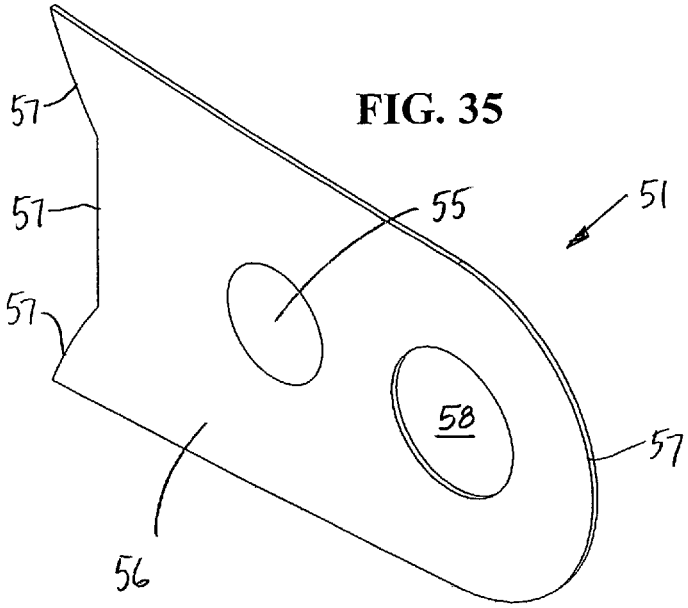
FIG. 35 is a perspective view of a spring element, according to another embodiment of this invention.
Figure 36:
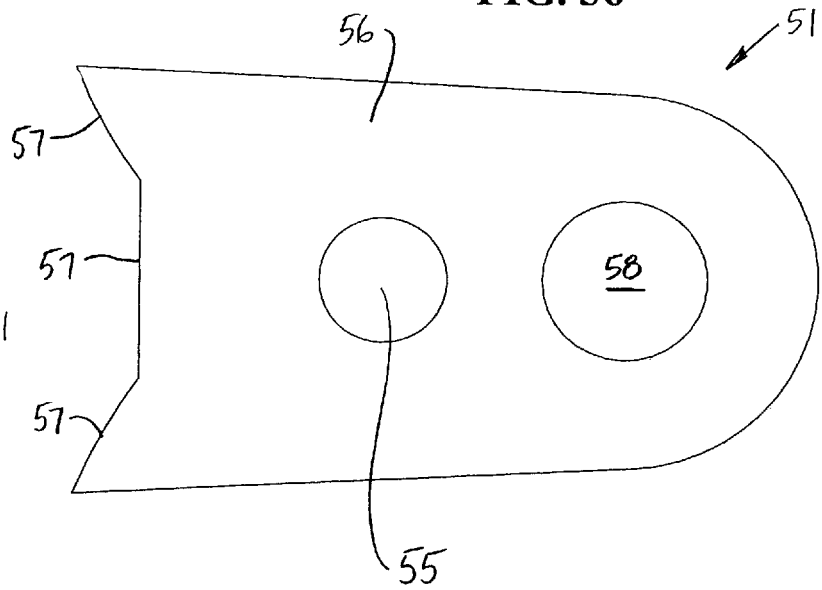
FIG. 36 is a front view of the spring element as shown in FIG. 35.
Figure 37:
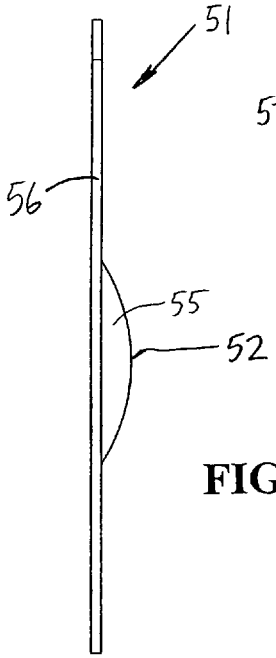
FIG. 37 is a side view of the spring element as shown in FIG. 35.

FIGS. 35-37 show one embodiment of spring element 51 that requires no lock tab 59 to retain the position of spring element 51 with respect to body 20 and/or blade 30.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

What is claimed is:

1. An expandable arrowhead comprising:

a blade-carrying body having a first slot and a second slot, a first blade having an impact portion and a cutting portion, at least a portion of said first blade movably mounted within said first slot, said impact portion and said cutting portion on opposite sides of said first slot, said first blade having an opening, a shaft mounted within said opening, said first blade pivoting about said shaft, and said shaft movably mounted within said second slot.

2. The expandable arrowhead according to claim 1, further comprising a spring element biasing said first blade into a retracted position.

3. The expandable arrowhead according to claim 2, wherein a force applied to said impact portion moves said first blade from said retracted position and into an expanded position.

4. The expandable arrowhead according to claim 2, wherein said spring element contacts an outer surface of said first blade.

5. The expandable arrowhead according to claim 2, wherein said first blade has a bore, and in said retracted position said spring element is positioned within said bore and engages said first blade.

6. The expandable arrowhead according to claim 2, wherein said spring element comprises a body with an opening, and said shaft is movably mounted within said opening.

7. The expandable arrowhead according to claim 2, wherein said spring element comprises a detent contacting said first blade in a retracted position.

8. The expandable arrowhead according to claim 7, wherein said first blade has a bore, and in said retracted position said spring element engages within said bore.

9. The expandable arrowhead according to claim 1, further comprising a second blade having a second impact portion and a second cutting portion, at least a portion of said second blade movably mounted within said first slot, and said second impact portion and said second cutting portion on opposite sides of said first slot.

10. The expandable arrowhead according to claim 9, further comprising a spring element biasing said first blade and said second blade in a retracted position.

11. The expandable arrowhead according to claim 10, wherein a force applied to said impact portion and/or said second impact portion overcomes a bias force of said spring element and moves said first blade and/or said second blade from said retracted position and into an expanded position.

12. The expandable arrowhead according to claim 10, wherein said second blade has a bore, and in said retracted position said spring element engages within said bore.

13. The expandable arrowhead according to claim 1, wherein said first slot extends from a first side to a second side opposite said first side of said blade-carrying body.

14. The expandable arrowhead according to claim 1, wherein said first slot and said second slot intersect each other.

15. The expandable arrowhead according to claim 1, wherein said first blade is movably mounted between said retracted position and an expanded position.

16. The expandable arrowhead according to claim 1, wherein said cutting portion is sharpened.

17. The expandable arrowhead according to claim 1, wherein said impact portion and said cutting portion are on opposite sides of a longitudinal axis of said blade-carrying body.

18. The expandable arrowhead according to claim 1, wherein said opening is a circular bore.

19. The expandable arrowhead according to claim 1, wherein said opening is a non-circular bore.

20. The expandable arrowhead according to claim 1, wherein said opening is a slot.

21. The expandable arrowhead according to claim 1, wherein said cutting portion is positioned opposite said impact portion.

22. An expandable arrowhead comprising:

a blade-carrying body having a first slot and a second slot, a blade having an impact portion and a cutting portion, said impact portion and said cutting portion on opposite sides of said first slot, said blade having an opening, a shaft mounted within said opening, said blade pivoting about said shaft, said shaft movably mounted within said second slot, and said blade movably mounted within said first slot and said blade following a pivoting and translating movement path when moving between a retracted position and an expanded position.

23. The expandable arrowhead according to claim 22 further comprising a spring element biasing said blade into a retracted position.

* * * * *